United States Patent [19]

Yasuda et al.

[11] Patent Number: 4,588,668

[45] Date of Patent: May 13, 1986

[54] POLYESTER RESIN, ELECTROPHOTOGRAPHIC DEVELOPER COMPOSITION

[75] Inventors: Shinichiro Yasuda; Eiji Morimoto; Yuichi Ueda, all of Wakayama, Japan

[73] Assignee: Kao Corporation, Tokyo, Japan

[21] Appl. No.: 616,981

[22] Filed: Jun. 4, 1984

[30] Foreign Application Priority Data

Jun. 10, 1983 [JP] Japan ..... 58-103617
Jun. 10, 1983 [JP] Japan ..... 58-103618

[51] Int. Cl.[4] ..... G03G 9/08
[52] U.S. Cl. ..... 430/109; 430/137
[58] Field of Search ..... 430/99, 106.6, 109, 430/122, 137

[56] References Cited

U.S. PATENT DOCUMENTS

Re. 31,072 11/1982 Jadwin et al. ..... 430/106.6
4,415,644 11/1983 Tamaki et al. ..... 430/109
4,448,871 5/1984 Tamaki et al. ..... 430/109
4,486,559 12/1984 Murata et al. ..... 525/120

*Primary Examiner*—John L. Goodrow
*Attorney, Agent, or Firm*—Birch, Stewart, Kolasch & Birch

[57] ABSTRACT

An electrophotographic developer composition, toner, comprises a binder of a polyester resin and a colorant, said polyeter resin having a softening point of 80° to 180° C., further having been obtained by copolycondensing (A) a diol component with (B) carboxylic acid components comprising (a) a dicarboxylic acid, (b) trimellitic acid and (c) a polycarboxylic acid. The composition possesses an improved fixation property.

4 Claims, No Drawings

POLYESTER RESIN, ELECTROPHOTOGRAPHIC DEVELOPER COMPOSITION

The present invention relates to a developer composition to be used for developing an electrostatic image in electrophotography, electrostatic recording and electrostatic printing.

In a conventional electrophotography, photoconductive insulating layer is charged uniformly and then exposed to erase the charge from the exposed part, thereby forming an electric latent image. A colored, charged, fine powder called "toner" is then applied to the latent image to visualize the image (developing step). The resulting visible image is transferred to a transfer material such as a transfer paper (transfer step) and the image is fixed permanently by a suitable fixing method such as heating or compression (fixing step) as described in the specifications of U.S. Pat. Nos. 2,297,691 and 2,357,809.

Thus, the toner must have functions required not only in the developing step but also in the transfer and fixing steps.

Generally, a toner is mechanically abraided by shearing forces and impact forces during the mechanical operation in a development device and, therefore, it deteriorates after the formation of several thousands to scores of thousands of copies. Through the deterioration of the toner can be prevented by using a tough resin having a high molecular weight and resistance to the mechanical friction force, such a resin has generally a high softening point and a low thermal efficiency in an oven fixing method (a non-contact fixing method) or an infrared radiant fixing method and, therefore, satisfactory fixing is not possible. When such a resin as above is used in a heat roller fixing method (a contact fixing method) which has been employed widely in virtue of a high thermal efficiency thereof, the temperature of the heat roller must be elevated for effecting satisfactory fixing. The temperature elevation invites a deterioration of the fixing device, curling of the paper and increase of energy consumption. In addition, when such a resin is used, the production efficiency is seriously reduced in the preparation of the toner by pulverization. Thus, binder resins having an excessively high degree of polymerization or softening point cannot be used. On the other hand, the heat roller fixing methods ranging from a low-speed method to a high-speed method have been employed frequently, since the surface of the heat roller is in close contact under pressure with the toner image surface of the sheet to be fixed to realize an extremely high thermal efficiency. However, the heat roller fixing method has the defect that when the heat roller surface is in contact with the toner image surface, the toner adheres to the heat roller surface and is thereby transferred to a subsequent transfer paper to cause the so-called offset phenomenon. To prevent this defect, the heat roller surface is treated with a material having excellent releasing properties such as a fluorine resin. Further, a releasing agent such as silicone oil is applied to the heat roller surface to prevent the offset phenomenon completely.

However, the method wherein the silicone oil is used is not preferred, since a large fixing device and a high cost are required and also complicated operations are necessitated which can cause troubles.

Another process for overcoming the defect of the offset phenomenon comprises broadening of the molecular weight distribution of the binder resin as described in the specifications of Japanese Patent Publication No. 6895/1980 and Japanese Patent Laid-Open No. 98202/1981. However, according to this process, the degree of polymerization of the resin is high and a high fixing temperature is required.

In an improved process, the offset phenomenon is prevented by asymmetrizing and crosslinking the resin as disclosed in the specifications of Japanese Patent Publication No. 493/1982 and Japanese Patent Laid-Open No. 44836/1975 and 37353/1982. However, the problem of the fixing temperature has not yet been solved.

Generally, the minimum fixing temperature lies between a cold offset temperature and a hot offset temperature. Therefore, the possible temperature ranges from the minimum fixing temperature to the hot offset temperature. The practical fixing temperature can be lowered by lowering the minimum fixing temperature as far as possible and also by elevating the minimum hot offset temperature as far as possible. By this means, the possible temperature range can be broadened, the energy can be saved, the highspeed fixing becomes possible and the curling of the paper can be prevented. Further, by this means, both side copying can be effected without causing any trouble. Thus, various merits can be obtained such as the possible use of the reproduction device as an intelligent device, accurate temperature control of the fixing device and increase of the tolerance.

Under these circumstances, the development of resins and toners having excellent fixability and offset resistance have been demanded.

To satisfy these requirements by using a styrene binder resin, there has been known a process wherein a paraffin wax or a low-molecular weight polyolefin is used as an offset inhibitor as disclosed in the specifications of Japanese Patent Laid-Open Nos. 65232/1974, 28840/1975 and 81342/1975. However, when such an offset inhibitor is used in a small amount, the intended effects cannot be obtained and when it is used in a large amount, it accelerates the deterioration of the developer. When the offset inhibitor is used in combination with a polyester resin, the effects obtained are only slight and when it is used in a large amount, it accelerates the deterioration of the developer. The polyester resins have essentially excellent fixability and the fixing can be effected sufficiently even by the non-contact fixing method as disclosed in the specification of U.S. Pat. No. 3,590,000. However, they could not be used easily in the heat roller fixing method, since the offset phenomenon occurs. Further, the polyester resins prepared from polycarboxylic acids and having an improved offset resistance have still an insufficient offset resistance, or even when they have a sufficient offset resistance, their intrinsic low-temperature fixability is sacrificed and they cannot be pulverized easily in the toner treatment step. In addition, problems are posed also in the preparation of the developer. These facts were pointed out in the specifications of Japanese Patent Laid-Open Nos. 44836/1975, 37353/1982 and 109875/1982.

Accordingly, an object of the present invention is to satisfy the above-mentioned requirements by providing a developer which can be fixed at a low fixing temperature without necessitating the application of the offset inhibitor in the heat roller fixing method and without causing the offset phenomenon.

Another object of the present invention is to provide a developer which can be fixed at a low fixing temperature without necessitating the addition of the offset inhibitor in the heat roller fixing method without causing the offset phenomenon.

Still another object of the invention is to provide a developer having a high fluidity and a long life (i.e. deterioration resistance) and free from blocking.

A further object of the invention is to provide a developer prepared from starting materials which can be kneaded and pulverized easily during the preparation steps.

After intensive investigations made for the purpose of attaining the above-mentioned objects, the inventors have completed the present invention.

The invention provides an electrophotographic developer composition which comprises a binder resin and a colorant, said binder resin comprising a polyester resin having a softening point of 80° to 180° C., said polyester resin having been obtained by copolycondensing:

(A) a diol component of the formula:

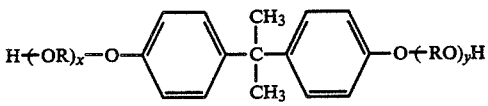

(I)

wherein R represents an ethylene or propylene group and x and y represent each an integer of at least 1, the average number of x+y being 2 to 7, with (B) carboxylic acid components comprising:

(a) a dicarboxylic acid, an anhydride thereof or a lower alkyl ester thereof, (b) trimellitic acid, an anhydride thereof or a lower alkyl ester thereof and (c) a polycarboxylic acid having one of the following formulae, an anhydride or a lower alkyl ester thereof,

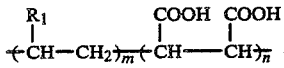

(II)

wherein $R_1$ represents an alkyl or alkenyl group having 20 to 60 carbon atoms, n+m is a number of 10 to 30 and the ratio of n to m is 1:4 to 4:1, the number-average molecular weight being 8,000 to 20,000

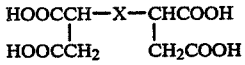

(III)

wherein X represents an alkylene or alkenylene group having 5 to 30 carbon atoms and at least one side chain having at least 3 carbon atoms.

The electrophotographic developer composition as defined above according to the invention includes the two preferable embodiments.

The first embodiment is characterized in that said polyester has a softening point of 100° to 180° C., said (B) carboxylic acid components have a softening point of 60° to 120° C. and said polycarboxylic acid (c) has the formula (II).

The second embodiment is characterized in that said dicarboxylic acid (a) contains an alkylsuccinic acid or an alkenylsuccinic acid and said polycarboxylic acid (c) has the formula (III), containing from 5 to 30 mol %, based on the total carboxylic acid components (B), of the (b), containing from 0.1 to 20 mol %, based on the total carboxylic acid components (B), of the (c).

In some cases, other polyols such as polyoxypropylene(12)-2,2-bis(4-hydroxyphenyl)propane, polyoxyphenylethylene(3)-2,2-bis(4-hydroxyphenyl)propane, glycerol, polyoxyethylene(6)glycerol and polyoxypropylene(12)-pentaerythritol may be added to the diol component in an amount of up to about 10 molar %. However, polyols having a high steric hindrance such as polyoxyphenylethylene(3)-2,2-bis(4-hydroxyphenyl)propane do not react rapidly. When a resin containing a highly hydrophilic polyol such as glycerol or polyoxyethylene(6)pentaerythritol is used, the image-forming properties of the developer are damaged. Thus, care should be taken in using the polyols.

The diol components (A) to be used in the present invention include, for example, polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxy ethylene(2.0)-2,2-bis(4-hydroxyphenyl)propane and polyoxypropylene(6)-2,2-bis(4-hydroxyphenyl)propane.

The dicarboxylic acids (a) in the carboxylic acid components (B) include, for example, fumaric acid, maleic acid, phthalic acid and alkyl- and alkenylsuccinic acids such as n-dodecenylsuccinic acid, isododecenylsuccinic acid, n-dodecylsuccinic acid, isododecylsuccinic acid, n-octylsuccinic acid, n-octenylsuccinic acid and n-butylsuccinic acid. By using the alkyl- or alkenylsuccinic acid, the minimum fixing temperature can be lowered without lowering the offsetcausing temperature. When the amount of this compound is insufficient, no intended effects can be obtained while when the amount is excessive, the Tg is lowered, the toner is caked easily and the reaction control becomes difficult. The amount of this compound is, therefore, preferably 5 to 30 molar % based on the carboxylic acid components.

Trimellitic acid (b) is an excellent acid component for overcoming the offset phenomenon. When the amount of trimellitic acid is insufficient, the intended effects cannot be obtained sufficiently. When the amount is excessive, the reaction control becomes difficult, no polyester resin having stable properties can be obtained, the resulting resin is too hard to be pulverized, the toner formation efficiency is reduced seriously and the minimum fixing temperature is elevated unfavorably. The amount of trimellitic acid is, therefore, preferably 5 to 30 molar % based on the carboxylic acid components The polycarboxylic acids (c) are relatively low molecular weight copolymers having an average molecular weight of 8,000 to 20,000, obtained by a copolymerization reaction of an α-olefin having 22 to 62 carbon atoms with maleic anhydride. The polymerization may take place to produce a randam copolymer or a block copolymer. The copolymerization ratio of the α-olefin to maleic anhydride is in the range of ¼ to 4/1. The polycarboxylic acids (c) have a softening point (a ring-and-ball softening point as determined according to the specification of ASTM-E28-51T) of 60° to 120° C. The α-olefins usable in this reaction include, for example, n-docosene (1), n-pentacosene-(1), n-dotriacontene-(1), n-tetracontene-(1), n-pentatetracontene-(1), n-pentacontene-(1), n-hexacontene-(1), 3-butyldocosene(1) and 3-ethylhexacosene-(1). Olefins other than the α-olefins, such as inner olefins, e.g. triacontene-(4) and hexacosene-(8) may also be contained therein in an amount of up to 10 wt. % based on the olefins, since a larger amount of these olefins causes caking of the toner. By using the polycarboxylic acid, the offset resistance can be improved without elevating the minimum fixing temperature in the fixing step. However, the use of an excessive amount of the polycarboxylic acid causes not only the caking of the toner but also difficulty of the reaction control. The amount of this compound is, therefore, 0.1 to 20 wt. %, preferably 1 to 10 wt. %, based on the carboxylic acid components.

The tetracarboxylic acids (c) being used in the present invention include, for example, the following compounds:

(1) 4-neopentylidenyl-1,2,6,7-heptanetetracarboxylic acid,
(2) 4-neopentyl-1,2,6,7-heptene(4)-tetracarboxylic acid,
(3) 3-methyl-4-heptenyl-1,2,5,6-hexanetetracarboxylic acid,
(4) 3-methyl-3-heptyl-5-methyl-1,2,6,7-heptene(4)tetracarboxylic acid,
(5) 3-nonyl-4-methylidenyl-1,2,5,6-hexanetetracarboxylic acid,
(6) 3-decylidenyl-1,2,5,6-hexanetetracarboxylic acid,
(7) 3-nonyl-1,2,6,7-heptene(4)-tetracarboxylic acid,
(8) 3-decenyl-1,2,5,6-hexanetetracarboxylic acid,
(9) 3-butyl-3-ethylenyl-1,2,5,6-hexanetetracarboxylic acid,
(10) 3-methyl-4-butylidenyl-1,2,6,7-heptanetetracarboxylic acid,
(11) 3-methyl-4-butyl-1,2,6,7-heptene(4)-tetracarboxylic acid, and
(12) 3-methyl-5-octyl-1,2,6,7-heptene(4)-tetracarboxylic acid, The structural formulae of these compounds will be shown below. They are shown in the form of acid anhydrides for convenience's sake:

(1)

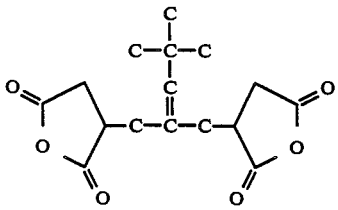

(2)

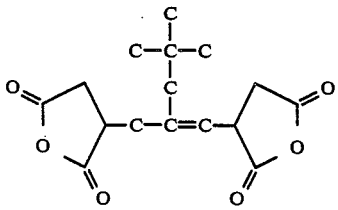

-continued (3)

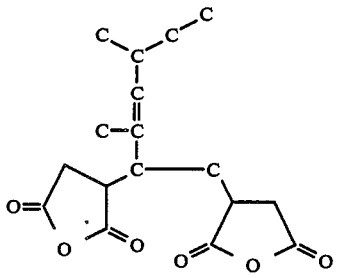

(4)

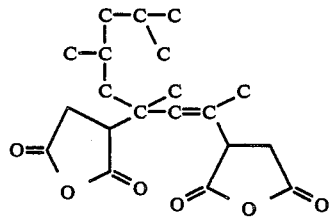

(5)

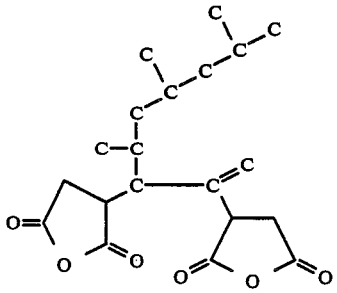

(6)

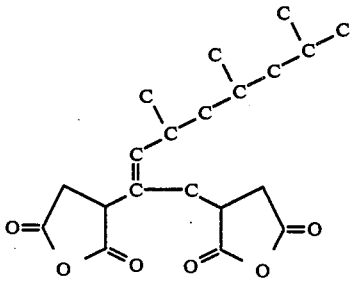

(7)

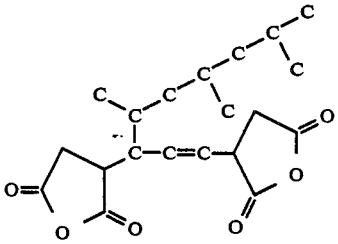

(8)

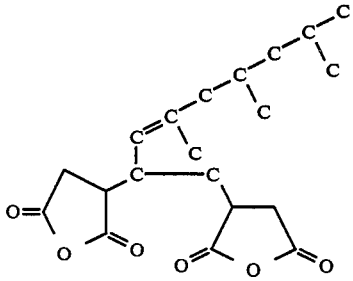

-continued (9)

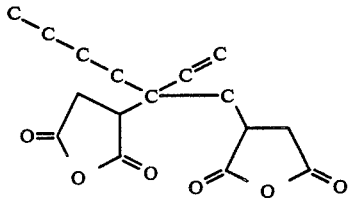

(10)

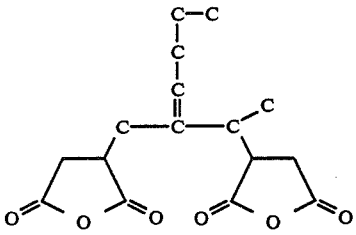

(11)

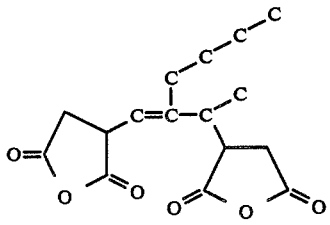

(12)

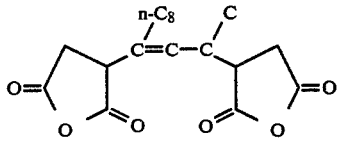

By using these tetracarboxylic acids, the minimum fixing temperature in the fixing step can be lowered and the offset resistance can be improved. When these compounds are used in a small amount, the intended effects cannot be obtained sufficiently while when they are used in a large amount, the fixability is damaged and the control of the polymerization degree of the resin in its preparation step becomes difficult. The amount of the tetracarboxylic acid is, therefore, 0.1 to 20 molar %, preferably 1 to 10 molar % based on the carboxylic acid components. There are similar tetracarboxylic acids such as aliphatic tetracarboxylic acids having no side chain or an only very short side chain, such as 1,2,7,8-octanetetracarboxylic acid, 1,2,5,6-hexanetetracarboxylic acid, 1,2,11,12-dodecanetetracarboxylic acid, 3-methyl-1,2,10,11-undecanetetracarboxylic acid and 4-ethyl-1,2,7,8-octene(4)-tetracarboxylic acid. However, the use of them is not preferred, since their effects of improving the low-temperature fixability and offset resistance are inferior to those of the tetracarboxylic acids having at least one side chain having 3 or more carbon atoms. Another reason is that when the amount of them is increased, the toner is easily caked and the reaction control in the preparation step becomes difficult. Further, alicyclic polycarboxylic acids and aromatic tetracarboxylic acids such as 3-methyl-5-succinyl-4-cyclohexene1,2-dicarboxylic acid, pyromellitic anhydride, benzophenonetetracarboxylic acid, cyclopentenetetracarboxylic acid and mellophanic acid have defects that many of them are decomposed, sublimed or colored in the course of the preparation of the resin and they have only poor effects of improving the low-temperature fixability and offset resistance.

In the preparation of the polyester resin according to the present invention, the ratio of the number of the hydroxyl groups in the diol component to the number of the carboxyl groups in the carboxylic acid components is in the range of 1.2 to 0.8, preferably 1.1 to 0.9. When the ratio is above 1.2 or below 0.8, the reaction does not proceed easily. When the number of carboxyl groups is excessive, the Tg and the softening point become too high and no satisfactory offset resistance can be obtained. On the other hand, when the number of the hydroxyl groups is excessive, the Tg is lowered, the toner is easily caked and the image-forming properties are damaged by the environmental changes.

The polyester resin to be used in the present invention has a softening point (ring-and-ball softening point according to the specification of ASTM-E28-51T) of preferably 80° to 180° C. A polyester resin having a lower softening point has an insufficient offset resistance and that having a higher softening point has an insufficient fixability.

The polyester resin being used in the present invention is prepared by polycondensing a polycarboxylic acid component with a polyol component in an inert gas atmosphere at a temperature of 180° to 250° C. An ordinarily used esterification catalyst such as zinc oxide, stannous oxide, dibutyltin oxide or dibutyltin dilaurate may be used for accelerating the reaction. Further, this reaction may be carried out under a reduced pressure for the same purpose as above.

The colorants to be used in the present invention include, for example, carbon black, acetylene black, Phthalocyanine Blue, Permanent Brown FG, Brilliant Fast Scarlet, Pigment Green B, Rhodamine B Base, Solvent Red 49, Solvent Red 146, Solvent Blue 35 and mixtures of them. The colorant is used generally in an amount of about 1 to 15 parts by weight per 100 parts by weight of the binding resin.

Magnetic substances being used in the present invention include, for example, alloys containing ferromagnetic elements such as ferrite and magnetite. The magnetic substance in the form of a fine powder having an average particle diameter of 0.1 to 1$\mu$ is dispersed in an amount of 40 to 70 wt. % in the binding resin.

Further, low-molecular weight polypropylenes and fatty acid ester waxes used generally as offset inhibitors may also be used, if necessary. The amount of them should be determined carefully, since an insufficient amount of them cannot realize the intended effects and an excess amount of them causes the deterioration of the developer.

The following Preparation Examples of the resins being used in the present invention and the Examples will further illustrate the present invention, which by no means limit the invention.

PREPARATION EXAMPLE 1

In a 2-l four-necked glass flask were charged 525 g of polyoxypropylene(2.2)-2,2-bis(4-hydroxyphenyl)propane, 487.5 g of polyoxyethylene(2)-2,2-bis(4-hydroxyphenyl)propane, 172.5 g of fumaric acid, 138 g of isooctylsuccinic acid and 0.1 g of hydroquinone. Then, the flask was fitted with a thermometer, stainless steel stirring rod, falling film condenser and nitrogen inlet tube. The mixture was stirred at 200° C. in nitrogen stream in an electrically heated mantle to carry out the reaction. When the running out of an effluent water stopped, the acid value of the product was determined to reveal that it was 1.0 mg KOH/g.

115.2 g of trimellitic anhydride and 21.3 g of copolymer A (having an average molecular weight of 8,000 and softening point of 60° C.) comprising 50 wt. % of an α-olefin having an average carbon number of 32 and 50 wt. % of maleic anhydride were added to the product and the reaction was carried out for about 8 H. The reaction was completed when an acid value of 25 mg KOH/g was obtained. The resulting resin was in the form of a light yellow solid having a softening point of 122° C. upon the completion of the reaction.

PREPARATION EXAMPLE 2

1,000 g of polyoxypropylene(2.2)-2,2-bis(4-hydroxyphenyl)propane, 237.1 g of terephthalic acid, 286 g of n-dodecylsuccinic acid, 0.5 g of stannous oxide and 0.1 g of hydroquinone were charged in the same device as in Preparation Example 1 and the reaction was carried out at 230° C. in nitrogen stream.

When the running out of an effluent water stopped, the acid value of the product was determined. The acid value was 1.5 mg KOH/g.

Further, 54.9 g of trimellitic anhydride and 29 g of copolymer B (having an average molecular weight of 10,000 and softening point of 75° C.) comprising 30 wt. % of an α-olefin having an average carbon number of 45 and 70 wt. % of maleic anhydride were added to the product and the reaction was carried out for about 8 H. The reaction was completed when a softening point of 125° C. was obtained.

The resulting product was in the form of a light yellow solid having an acid value of 16 mg KOH/g.

EXAMPLE 1

93 parts of the resin obtained in Preparation Example 1 was mixed with 7 parts of carbon black in a ball mill. The mixture was then kneaded in a compression kneader for 30 min, cooled, roughly pulverized and finally finely pulverized in a jet pulverizer to obtain a toner having an average particle diameter of 12μ.

95 parts by weight of a powdery iron carrier was added to 5 parts by weight of the toner to prepare a developer. After an image formation by means of a reproduction machine, the fixability and offset were examined. The fixing was insufficient at 110° C. but was sufficient at 120° C. The surface temperature of the heat roller was elevated at intervals of 10° C. No offset was observed even at 240° C.

The reproduction machine used was a commercially available reproduction machine (Xerox 2830; a product of Fuji Xerox Co.). This machine was modified so that the surface temperature of the heat roller could be changed at will and an offset-inhibiting sleeve was removed, leaving a silicone rubber fixing roller and a Teflon coated heat roller. The fixability was judged by applying a cellophane tape to a solid area having an optical image density determined by means of a Macbeth reflection densitometer of 1.0 to 1.1 under a given pressure and then peeling the tape off at a given rate. The fixability was represented by the results (i.e. whether the toner adhered to the cellophane tape or not).

EXAMPLES 2 to 5 and COMPARATIVE EXAMPLES 1 to 5

The tests and comparative tests were effected using a polyester resin synthesized in the same manner as in Preparation Example 1. The conditions and the results are summarized in Table 1.

It is apparent from Table 1 that the developer composition containing the resin of the present invention can be fixed at a temperature lower than that of the comparative composition and no offset is caused at a temperature higher than the offset temperature of the comparative composition. When the developer containing a quite preferred resin was used, the deterioration phenomenon such as void formation in a solid area, edging phenomenon, staining or lack of line sharpness was not observed at all.

TABLE 1

| | Diol (molar ratio) | | | Polycarboxylic acid (molar ratio) | | | | |
|---|---|---|---|---|---|---|---|---|
| | BPA(2.2)PO*1 | BPA(2)EO*2 | EPA(6)PO*3 | FA*4 | TPA*5 | i-OSA*6 | n-DSA*7 | TMA*8 |
| Ex. | | | | | | | | |
| 1 | 0.5 | 0.5 | — | 0.5 | — | 0.2 | — | 0.2 |
| 2 | 1.0 | — | — | — | 0.5 | — | 0.35 | 0.1 |
| 3 | 0.8 | — | 0.2 | 0.5 | — | 0.125 | — | 0.25 |
| 4 | 0.7 | 0.3 | — | — | 0.4 | 0.3 | — | 0.2 |
| 5 | 0.7 | 0.3 | — | — | 0.4 | 0.3 | — | 0.2 |
| Comp. Ex. | | | | | | | | |
| 1 | 0.5 | 0.5 | — | 0.5 | — | 0.2 | — | 0.2 |
| 2 | 1.0 | — | — | — | 0.5 | — | 0.35 | 0.1 |
| 3 | 0.7 | 0.3 | — | — | 0.4 | 0.3. | — | 0.2 |
| 4 | 0.5 | 0.5 | — | — | 0.4 | — | — | 0.4 |
| 5 | 0.5 | 0.5 | — | — | 0.2 | 0.2 | — | 0.4 |

| | Polycarboxylic acid (wt. %) (A)*9 | (B)*10 | Softening point (°C.) | Offset-causing temp. (°C.) | Minimum fixing temp. (°C.) | Toner formation and image evaluation |
|---|---|---|---|---|---|---|
| Ex. | | | | | | |
| 1 | 5 | — | 122 | 240 | 120 | easily pulverizable good image |
| 2 | — | 5 | 125 | 240 | 130 | easily pulverizable good image |
| 3 | 7 | — | 130 | 240 | 140 | easily pulverizable good image |
| 4 | — | 5 | 120 | 240 | 130 | easily pulverizable good image |
| 5 | — | 5 | 125 | 240 | 140 | easily pulverizable good image |
| Comp. Ex. | | | | | | |
| 1 | — | — | 122 | 200 | 160 | good image high fixing temp. |
| 2 | — | — | 125 | 220 | 160 | good image high fixing temp. |
| 3 | — | — | 125 | 220 | 160 | good image high fixing temp. |
| 4 | — | — | 122 | 240 | 180 | poor toner formation pulverizability |
| 5 | — | — | The preparation was impossible due to | | | toner could not be formed |

TABLE 1-continued

| |
|---|
| to excessively high reaction rate and gelation |

(Notes)
*1 BPA(2.2)PO: polyoxypropylene(2.2)-2,2-bis(4-hydroxyphenyl)propane
*2 BPA(2)EO: polyoxyethylene(2)-2,2-bis(4-hydroxyphenyl)propane
*3 BPA(6)PO: polyoxypropylene(6)-2,2-bis(4-hydroxyphenyl)propane
*4 FA: fumaric acid
*5 TPA: terephthalic acid
*6 i-OSA: isooctylsuccinic acid
*7 n-DSA: n-dodecylsuccinic acid
*8 TMA: trimellitic anhydride
*9 polycarboxylic acid (A): copolymer A used in Preparation Example 1
*10 polycarboxylic acid (B): copolymer B used in Preparation Example 2

PREPARATION EXAMPLE 3

In a 2-l four-necked glass flask were charged 525 g of polyoxypropylene(2.2)-2,2-bis(4-hydroxyphenyl)propane, 488 g of polyoxyethylene(2)-2,2-bis(4-hydroxyphenyl)propane, 139 g of fumaric acid, 126 g of trimellitic acid, 60 g of 3-isodecenyl-1,2,5,6-hexanetetracarboxylic acid, 170 g of isododecenylsuccinic acid and 1.5 g of hydroquinone. Then, the flask was fitted with a thermometer, stainless steel stirring rod, falling-film condenser and nitrogen inlet tube. The mixture was stirred at 200° C. in nitrogen stream in an electrically heated mantle to carry out the reaction. The degree of polymerization was determined by following the softening point according to the specification of ASTM E 28-51 T. The reaction was stopped when the softening point had reached 122° C. The resulting resin was in the form of a light yellow solid having a glass transition temperature determined by means of a DSC (differential scanning calorimeter) of 62° C.

COMPARATIVE PREPARATION EXAMPLE 1

A resin was prepared in the same manner in the same device as in Preparation Example 3 except that no 3-isodecenyl-1,2,5,6-hexanetetracarboxylic acid was used. The reaction was stopped when the softening point had reached 122° C. The resulting resin was in the form of a yellow solid having a glass transition point of 62° C.

EXAMPLE 6

93 parts of the resin obtained in Preparation Example 3 was mixed with 7 parts of Diablack MA-8 (a carbon black of Mitsubishi Kasei Co., Ltd.) in a ball mill to effect milling. The mixture was further kneaded in a compression kneader and then cooled. The mixture was finely pulverized in a jet pulverizer to obtain a toner having an average particle diameter of 12$\mu$. 5 parts by weight of the resulting toner was mixed with 95 parts of a powdery iron carrier to prepare a developer. After an image formation by means of a reproduction machine, the fixability and offset were examined. The fixing was insufficient at 110° C. but was sufficient at 120° C. The surface temperature of the heat roller was elevated at intervals of 10° C. The offset was caused at 230° C.

EXAMPLES 7 to 12 and COMPARATIVE EXAMPLES 6 to 10

The tests and comparative tests were effected using a polyester resin synthesized in the same manner as in Preparation Example 3. The conditions and the results are summarized in Table 2.

TABLE 2

| | Diol (mol) | | | Other polyol | Polycarboxylic acid (mol) | | | | | | Softening point | Offset temp. | Minimum fixing temp. | Toner formation |
|---|---|---|---|---|---|---|---|---|---|---|---|---|---|---|
| | BPA(202)PO*1 | BPA(2)EO*2 | BPA(6)PO*3 | (mol) | FA*4 | TPA*5 | iPA*10 | Alkyl- or alkenylsuccinic acid*11 | TMA*8 | Tetra-carboxylic acid*12 | (°C.) | (°C.) | (°C.) | image evaluation |
| Ex. | | | | | | | | | | | | | | |
| 6 | 0.5 | 0.5 | — | — | 0.4 | — | — | 0.2 (A) | 0.2 | 0.05 (P) | 122 | 230 | 120 | good pulverizability and image in the toner formation |
| 7 | 0.7 | 0.3 | — | — | — | 0.3 | — | 0.3 (B) | 0.2 | 0.05 (P) | 125 | 240 | 130 | good pulverizability and image in the toner formation |
| 8 | 0.9 | — | 0.1 | — | — | 0.35 | — | 0.2 (B) | 0.1 | 0.05 (Q) | 123 | 230 | 130 | good pulverizability and image in the toner formation |
| 9 | 1.0 | — | — | — | — | — | 0.45 | 0.2 (B) | 0.2. | 0.025 (Q) | 122 | 240 | 130 | good pulverizability and image in the toner formation |
| 10 | 1.0 | — | — | — | 0.65 | — | — | 0.1 (B) | 0.05 | 0.1 (Q) | 120 | 230 | 130 | good pulverizability and image in the toner formation |
| 11 | 1.0 | — | — | — | 0.65 | — | — | 0.1 (B) | 0.05 | 0.1 (Q) | 130 | 240 | 140 | good pulverizability and image in the toner formation |
| 12 | 0.7 | 0.3 | — | 0.07 (glycerol.3PO) | — | 0.45 | — | 0.1 (C) | 0.05 | 0.1 (R) | 123 | 230 | 130 | good pulverizability and image in the toner formation |
| Comp. Ex. | | | | | | | | | | | | | | |
| 6 | 0.45 | 0.45 | — | — | 0.4 | — | — | 0.2 (A) | 0.2 | — | 122 | 200 | 160 | Non-offset region is narrow |
| 7 | 0.67 | 0.33 | — | — | — | 0.3 | — | 0.3 (B) | 0.2 | — | 125 | 220 | 160 | Non-offset region is narrow |
| 8 | 1.0 | — | — | — | 0.65 | — | — | 0.1 (B) | 0.05 | 0.1 (pyromellitic anhydride) | 122 | 230 | 180 | Fixing temp. is high |
| 9 | 1.0 | — | — | — | 0.65 | — | — | 0.1 (B) | 0.05 | 0.1 (S) | 120 | 240 | 180 | Fixing temp. is high |
| 10 | 0.5 | 0.5 | — | — | 0.2 | — | — | 0.1 (B) | 0.4 | 0.05 (P) | The control was impossible due to excessively high reaction rate | | | |

(Notes)
*1, *2, *3, *4, *5, *8 are defined in Table 1.
*10 iPA: isophthalic acid
*11 alkyl- or alkenylsuccinic acid
(A): isododecenylsuccinic acid MW 284
(B): isooctylsuccinic acid MW 228
(C): n-dodecenylsuccinic acid MW 284
*12 tetracarboxylic acid:
(P): 3-isodecenyl-1,2,5,6,-hexanetetracarboxylic acid
(Q): 4-neopentyl-1,2,6,7-heptene(4)-tetracarboxylic acid
(R): 3-methyl-5-octyl-1,2,6,7-heptene(4)-tetracarboxylic acid
(S): 4-ethyl-1,2,7,8-octene(4)-tetracarboxylic acid.

The embodiments of the invention in which an exclusive property or privilege is claimed are defined as follows:

1. An electrophotographic developer composition which comprises a binder resin and a colorant, said binder resin comprising a polyester resin having a softening point of 80° to 180° C., said polyester resin having been obtained by copolycondensing:

(A) a diol component of the formula:

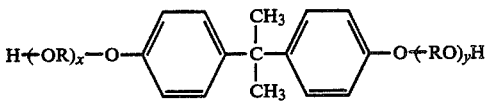

(I)

wherein R represents an ethylene or propylene group and x and y represent each an integer of at least 1, the average number of x+y being 2 to 7, with (B) carboxylic acid components comprising:

(a) a dicarboxylic acid, an anhydride thereof or a lower alkyl ester thereof, (b) trimellitic acid, an anhydride thereof or a lower alkyl ester thereof and (c) a polycarboxylic acid having one of the following formulae, an anhydride or a lower alkyl ester thereof,

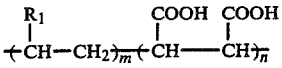

(II)

wherein $R_1$ represents an alkyl or alkenyl group having 20 to 60 carbon atoms, n+m is a number of 10 to 30 and the ratio of n to m is 1:4 to 4:1, the number-average molecular weight being 8,000 to 20,000

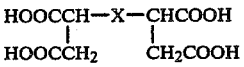

(III)

wherein X represents an alkylene or alkenylene group having 5 to 30 carbon atoms and at least one side chain having at least 3 carbon atoms.

2. An electrophotographic developer composition as claimed in claim 1, in which said polyester has a softening point of 100° to 180° C., said (B) carboxylic acid components have a softening point of 60° to 120° C. and said polycarboxylic acid (c) has the formula (II).

3. An electrophotograhic developer composition as claimed in claim 1, in which said dicarboxylic acid (a) contains an alkylsuccinic acid or an alkenylsuccinic acid and said polycarboxylic acid (c) has the formula (III). containing from 5 to 30 mol % of (b), based on the total carboxylic acid components (B)? and containing from 0.1 to 20 mol % of (c), based on the total carboxylic acid components (B).

4. An electrophotographic developer composition as claimed in claim 1, wherein the ratio of the number of the hydroxyl groups in the diol component to the number of the carboxyl groups in the carboxylic acid components is in the range of 1.2 to 0.8.

* * * * *